US009534867B2

(12) United States Patent
Dunn et al.

(10) Patent No.: US 9,534,867 B2
(45) Date of Patent: Jan. 3, 2017

(54) FIREARM SECURITY APPARATUS

(71) Applicant: Boomstix, LLC, Albuquerque, NM (US)

(72) Inventors: Mark M. Dunn, Rio Rancho, NM (US); Gregory K. Gowen, Albuquerque, NM (US); David M. Stafford, Albuquerque, NM (US)

( * ) Notice: Subject to any disclaimer, the term of this patent is extended or adjusted under 35 U.S.C. 154(b) by 0 days.

(21) Appl. No.: 14/641,021

(22) Filed: Mar. 6, 2015

(65) Prior Publication Data

US 2015/0260480 A1 Sep. 17, 2015

Related U.S. Application Data

(60) Provisional application No. 61/954,097, filed on Mar. 17, 2014.

(51) Int. Cl.

| | |
|---|---|
| ***F41A 17/00*** | (2006.01) |
| ***F41C 33/06*** | (2006.01) |
| ***E05G 1/00*** | (2006.01) |

(52) U.S. Cl.

CPC ..... *F41C 33/06* (2013.01); *E05G 1/00* (2013.01)

(58) Field of Classification Search

CPC ..... F41A 23/18; F41A 17/02; F41A 17/04; F41A 17/54; F41C 33/06

USPC ..... 42/70.11, 70.07

See application file for complete search history.

(56) References Cited

U.S. PATENT DOCUMENTS 1,513,267 A * 10/1924 Parks ..... F41A 17/02 42/70.11
5,050,330 A * 9/1991 Pilgrim ..... F42B 39/00 211/64
5,138,786 A * 8/1992 Fischer ..... F41A 17/02 211/64
5,392,552 A * 2/1995 McCarthy ..... F41A 17/54 42/70.06
5,621,996 A * 4/1997 Mowl, Jr. ..... F41A 23/18 211/64
5,918,402 A * 7/1999 Weinraub ..... F41A 17/54 42/70.07
6,009,654 A * 1/2000 Williams ..... F41C 33/06 206/317
6,330,815 B1 * 12/2001 Duncan ..... B60R 7/14 211/4
6,427,497 B1 * 8/2002 Mossberg, Jr. ..... A47B 81/005 211/4

(Continued)

OTHER PUBLICATIONS

Shotlock, LLC; "AR Solo-Vault for Full Framed AR Rifles"; four screen shots captured from website at www.shotlock.com; last accessed Feb. 26, 2016; Wolley, WA, USA.

*Primary Examiner* — Michael David

(74) *Attorney, Agent, or Firm* — Rod D. Baker

(57) ABSTRACT

An apparatus for storing a firearm, particularly a long gun, in a secure manner but in which the firearm is readily available to an authorized person. The apparatus may be mounted on a vertical wall. A door assembly is pivotally connected to a main housing and can be locked in a closed position to secure the interior of the housing against unauthorized entry. Adjustable access inhibitor components allow the apparatus to be customized for use with a user-selected model of firearm without compromising security. Movable components within the housing interior hold the selected firearm in a desired position.

18 Claims, 9 Drawing Sheets

(56) References Cited

U.S. PATENT DOCUMENTS

| | | | | |
|---|---|---|---|---|
| 6,438,885 | B1 * | 8/2002 | Murray | F41A 17/54 211/64 |
| 6,488,148 | B1 * | 12/2002 | Woodson | B65D 25/10 206/1.5 |
| 6,845,640 | B2 * | 1/2005 | Loeff | E05B 53/003 109/45 |
| 6,880,282 | B1 * | 4/2005 | Olsen | F41A 17/44 211/64 |
| 7,448,156 | B2 * | 11/2008 | Tucich | F41A 23/18 211/64 |
| 8,375,752 | B2 * | 2/2013 | Chang | E05B 37/0031 70/162 |
| 8,890,694 | B2 * | 11/2014 | Yang | H05K 5/0208 340/10.1 |
| 9,010,007 | B2 * | 4/2015 | Chandler | F41A 17/04 206/315.11 |
| 2002/0133998 | A1 * | 9/2002 | Murray | F41A 17/54 42/70.07 |
| 2007/0051026 | A1 * | 3/2007 | Vor Keller | F41A 17/02 42/70.11 |

* cited by examiner

FIREARM SECURITY APPARATUS

CROSS-REFERENCE TO RELATED APPLICATIONS

This application claims the benefit of the filing of U.S. Provisional Patent Application No. 61/954,097 entitled "Firearm Security Device" filed on 17 Mar. 2014, the entire disclosure of which is incorporated herein by reference.

BACKGROUND OF THE INVENTION

Technical Field

The present invention relates generally to the field of firearms security, more particularly to an apparatus for securely storing long rifles and shotguns, and specifically to a firearm security apparatus that allows an authorized person to access a secured firearm quickly in the event of an emergency.

Background Art

Firearms ownership is common in the United States of America, and is increasing in popularity in this and other nations. A vast majority of firearms owners are responsible and exercise care in the use and storage of their firearms. One desirable aspect of responsible firearms ownership is the secure storage of the firearm(s) against their access by unauthorized persons including thieves and children. However, another facet of firearms ownership is the right to use a firearm for self-defense, especially within the firearm owner's home or business. Thus, there is a need for a means and method for storing a firearm against unauthorized use, but in a manner permitting rapid access to the firearm when needed for personal defense (e.g., in the event of a criminal home invasion), or under other exigent circumstance, such as a house fire or natural disaster.

Presently, there exists in the art a variety of firearm racks, retainers, security locks, safes, lockboxes and other devices constructed for the purpose of securing and protecting one or more firearms. Many such devices are customized for use in securing and protecting handguns, but others are adapted specially to accommodate long guns. "Long guns" commonly (but not necessarily exclusively) refers to shotguns having a barrel length of at least eighteen inches, or rifles having a barrel length of at least sixteen inches. Conventional heavyweight safes offer optimum security, but typically are not opened quickly and are always bulky.

Some devices adapted to secure long guns are configured to support on the butt end of the firearm most of its weight, with some support on a point on the barrel, in order to distribute the mass of the firearm, as well as to permit reasonable access to the firearm. Means for securing or locking the firearm include trigger guard key lock assemblies, as well as barrel capture/locking mechanisms. In single-weapon racks and holders, a few known security devices may be customized to receive a single type or style of rifle or shotgun. However, many security firearm racks known in the art cannot accommodate mounting rails, scopes, lights and other accessories frequently attached to a long gun. Gun racks known in the art typically are wall-mounted or free standing, and occupy substantial space. Those long gun storage devices which do offer some adjustability nevertheless are restricted to a limited selection of models of rifle or shotgun.

Significant effort has been expended in the past to provide rapid-entry security devices for use with handguns. Relatively little effort has been made in this regard respecting long guns. Long guns nevertheless are suitable and sometimes preferable tools for use in home and personal defense.

Thus, there remains an unmet need for an apparatus and method for safely and securely storing a long gun against unauthorized access, but which also permits an authorized user facile and rapid access to the weapon in an urgent time of need. The presently disclosed apparatus more fully satisfies, among others: (a) the need for a versatile long gun security apparatus that is adaptable/adjustable to accommodate a wide variety of types, styles and sizes of long guns, including firearms equipped with a telescope, lights, or other accessories; and (b) the need for a long gun security apparatus that is simply and rapidly used to access the weapon, and yet offers reasonably reliable protection against unauthorized access.

Against the foregoing background, the presently disclosed apparatus was invented.

SUMMARY OF THE DISCLOSURE

There is disclosed a versatile firearm secure storage apparatus and system. Problems with mounting, space requirements, limited model/type/size accommodations, accessibility, and other problems are addressed by embodiments of the present invention, and will be understood by those skilled in the art upon reading the following specification. The present apparatus is particularly well-suited to satisfy unmet needs for storing long guns, but its use is not strictly so limited.

In one embodiment of an apparatus according to this disclosure, a housing is provided, for example of sheet metal, which includes a plurality of components formed and assembled to be adjustable by way of various fasteners such as, but not limited to, screws, rivets, and dowels. The components are arranged in such a fashion so as to allow them according to their design to be moved and temporarily fastened in place, allowing for a firearm of choice to be placed securely inside the housing. A moveable lid or door assembly is included and featuring a locking mechanism to hold fast the door, after closure, to secure the firearm.

According to the firearm profile as it relates to the upper and lower access in the housing, a plurality of access inhibitors may be placed according to the design which inhibits access to the interior of the apparatus housing by closely following the contour or profile of the firearm, as yet permitted by the spacing allowed by the housing design. These access inhibitors may be fastened in place by screws, rivets or other typical or similar fasteners such that when the door assembly is closed, the access inhibitors may be captured by or engaged with the door in a manner such that they are supported by and gain structural integrity from the closed door or lid, especially after the locking mechanism is engaged.

Additionally, a forward adjustment support mechanism, preferably including movable clamp members, may be employed to allow for rifles or shotguns of varying width (as referenced from back to front) once mounted in place according to the use of the apparatus. A firearm to be accommodated and may be held in place by a gentle force applied by the forward adjustment support mechanism as it contacts the firearm and applies pressure holding the weapon securely between the rear wall of the housing and the interior of the door. The forward support mechanism can be reliably attached to the housing interior in any of at least two differing locations so to promote versatility of the apparatus to accommodate different types, styles and sizes of long guns, with or without scopes or other accessories attached.

There also is provided a trigger guard support assembly within the housing for engagement with the interior of the trigger guard of the long gun to provide additional support for the weapon and yet secure against accidental depression of the trigger. The trigger guard support assembly preferably may be reliably attached to the housing interior in any of at least two differing locations so to promote versatility of the apparatus to accommodate long guns having a variety of trigger guard configurations or dimensions. The trigger guard support assembly preferably includes an adjustable trigger guard support to adapt the assembly to differing firearms. The trigger guard support assembly preferably includes a trigger safety pin to safeguard against operation of the firearm trigger.

An object of the present invention is to provide a firearm security apparatus that is customizable or adjustable to receive, secure, and protect firearms having a wide variety of shapes, sizes, and configurations.

Another object of the present invention is to provide a firearm security apparatus that is customizable adjustable to receive, secure, and protect firearms with or without an accessory such as scope, mounted upon the firearm.

Yet another object of the present invention is to provide a firearm security apparatus that permits rapid authorized access to a firearm secured therein.

An advantage of the apparatus of the present invention is that it is relatively simple in fabrication and use.

Another advantage of the apparatus of the present invention is that it can be manufactured relatively affordably.

BRIEF DESCRIPTION OF DRAWINGS

Illustrative embodiments that incorporate one or more features according to the invention are described with reference to the following drawings. The drawings are not necessarily to scale, but like numerals are used among the several views to label like elements and components.

The drawings illustrate, but do not strictly delimit, embodiments of the invention. In the drawings.

DETAILED DESCRIPTION OF A PREFERRED EMBODIMENT

Figure 1A:
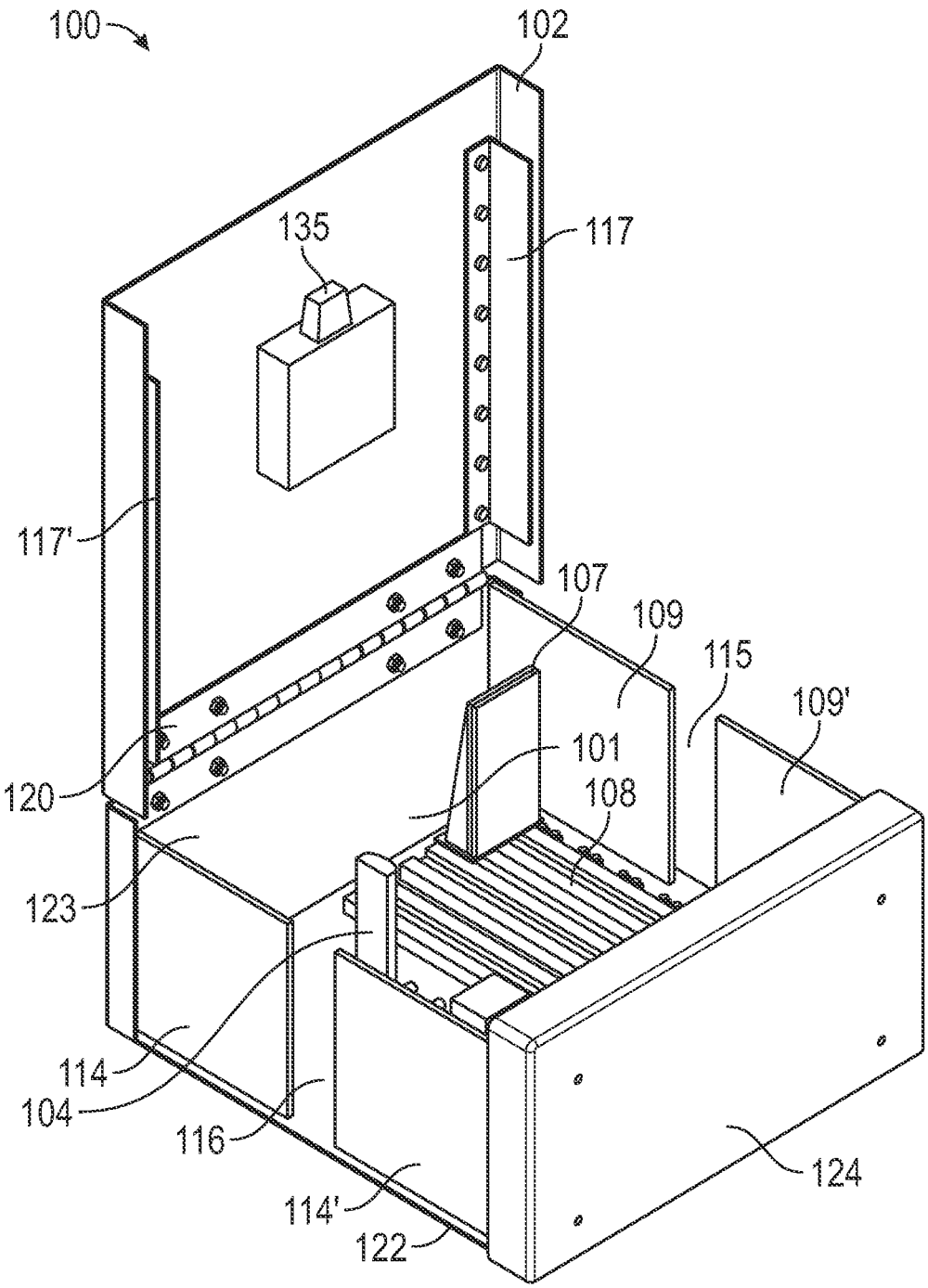
FIG. 1A is a perspective front view of an apparatus according to the present disclosure, showing the two foundational components being a main housing and a door assembly connected with a hinge to the main housing.

In the following detailed description, a preferred embodiment is described in sufficient detail so as to enable one skilled in the art to practice the invention. It is understood that other embodiments may be devised, and that logical, mechanical, material and various other assemblies may be made without departing from the scope of the present invention. The following description therefore is, therefore, to disclose the invention but not necessarily to limit its scope.

A large variety of rifle and shotgun models are available lawfully to the American home or business owner. Security methods and fixtures for long guns vary according to the broad range of profiles and periphery available for use on the many types and models of weapons. Maintaining security and accessibility of long rifles and shotguns in a universal format is currently not available in a manufactured product. The presently disclosed apparatus and method was created to achieve security and accessibility rapidly and quietly, including in dark conditions. The invention is adaptable to a large variety of rifles and shotguns, and increases the user's ability to respond to threats of home invasion or acts of hostility.

Embodiments of the presently disclosed apparatus demonstrate the usefulness and superiority of the present invention over the prior art. The present apparatus partially or completely avoids or ameliorates shortcomings of devices know in the art. For example, the present apparatus is not noisy or cumbersome when attempting to remove the rifle or shotgun from the secure mount. In extracting the weapon from the present apparatus, little time or effort is required. A long gun can be quietly retrieved from the present apparatus, facilitating the element of surprise.

The invention described herein is intended to overcome many of the current challenges in the securing and rapid deployment of the personal rifle or shotgun for home or business security, while also demonstrating nearly universal utility with the many different models and configurations of available long guns.

The apparatus according to this disclosure is intended primarily for use with long guns, but is not necessarily or strictly so limited. It is sufficiently versatile as to accommodate certain selected handguns as well.

There is provided an apparatus for securing a firearm. The apparatus is configured particularly to be mounted upon a vertical surface such as a wall or door, and preferably is so mounted. But the apparatus may be mounted on a horizontal surface, and indeed is mountable upon practically any generally planar surface regardless of its orientation in three-dimensional space. It may also be used in an unmounted condition, although such use may compromise some of its benefits and advantages.

The apparatus disclosed hereby preferably but not necessarily is fabricated primarily from metal, and most of its various elements and components are composed of machined or stamped metal alloy. Nevertheless, the invention is not limited to any particular composition or mode of fabrication unless specifically so recited in the appended claims. Certain elements may desirably be fabricated from rolled sheet metal, or from suitable plastics or composites.

The security apparatus features a main housing partially defining a hollow interior, and a lid or door assembly swingably connected to the housing. The apparatus housing, particularly when the door assembly is closed, is of a convenient size for mounting at strategic and/or discrete locations within a home or business. For example, with the door assembly defining the front of the apparatus, the apparatus (when mounted on a vertical supporting surface) may have dimensions of between about 8.0 inches (20 cm) and about 15.0 inches (38 cm) in lateral width, and between about 8.0 inches (20 cm) and about 10 inches (25 cm) in height, and between about 3.5 inches (9.0 cm) and about 6.0 inches (15 cm) deep (front to back). All these dimensions are offered by way of example rather than limitation. The door assembly can be pivoted to a closed position thereby to generally enclose the housing interior. The housing has a back, which may be adapted to be mounted, as by screws or bolts, to a supporting surface such as an interior wall of a dwelling or business establishment. Thus the security apparatus preferably is securely bolted or screwed to a wall or door.

Within the housing interior is an upper adjustment support assembly adapted to hold a forward portion of a firearm. This support assembly preferably includes (a) a clamps track that is movably attachable to the housing back at any of a plurality of locations within the housing interior, and (b) two (at least) side clamp members upon the side clamps track, at least one of which is movably positionable upon the clamps track to adjust a clamp member separation distance between the side clamp members. The support assembly is devised to reliably yet releasably hold therein the forestock or barrel of a long gun. The side clamp members of the support assembly can be positioned so that the separation distance between the side clamp members is nearly equal to, or slightly greater than, the associated profile of the firearm, such that the portion of the firearm between these side members is supported by those members (optionally with a gentle clamping action). The support assembly thus holds the forward portion of the firearm in position within the security apparatus.

Also within the housing interior is a trigger guard support assembly. The trigger guard support assembly includes a trigger guard base member that is movably attachable to the back of the housing at any of a plurality of positions within the housing interior, and a trigger guard support extending from the trigger guard base. There preferably though optionally may be provided a track member on the back of the housing, upon which the trigger guard base member is slidably attached so as to be movable along the track, to be temporarily secured at a selected position along the track. The trigger guard support assembly is configured to bear much or nearly all the weight of a firearm when the security apparatus is mounted on a vertical supporting surface, with the firearm secured therein. The weight of the firearm is transmitted to the trigger guard support assembly via the forward portion of the firearm's trigger guard.

Combined reference is made to FIGS. 1A, 1B, 1C, and 1D depicting the firearm security apparatus 100. The apparatus 100 features two main subassemblies, the main housing 101 (with its contents) and the door assembly 102. Door assembly 102 is mechanically coupled to the housing 101 via one or more suitable heavy-duty hinges 120 (e.g., a single pin-and-knuckle "piano" hinge). The housing 101 has a mostly hollow interior defined partially by the housing back 122, and a housing first wall 123 and a housing second wall 124. The walls may be reinforced as needed in suitable ways familiar in the art. The door assembly 102 is pivotally connected to one of the housing walls (e.g., first wall 123) and is movable between an open position (seen partially open in FIGS. 1A-1D) and a closed position in which the door assembly is approximately parallel to the back 122. When the door assembly 102 is in the closed position, the interior of the housing 101 is enclosed on four sides by the back 122, side walls 123, 124, and the door assembly. The top and bottom of the housing interior are defined by access inhibitors 109, 109', 114, and 114', to be described further. The first and second walls 123, 124 extend forward from the back 122, and may be integrally formed therewith, for example by forming the back and the walls from a single piece of sheet metal. The housing walls 123, 124 preferably are parallel to each other, and each defines an approximately 90-degree angle with the back 122. The hinge 120 preferably is securely connected to the interior side of the door assembly 102 and one of the walls 123 or 124, such that when the door assembly 102 is in the closed position, the hinge 120 is within the housing interior and thus inaccessible from outside the housing.

Figure 1B:
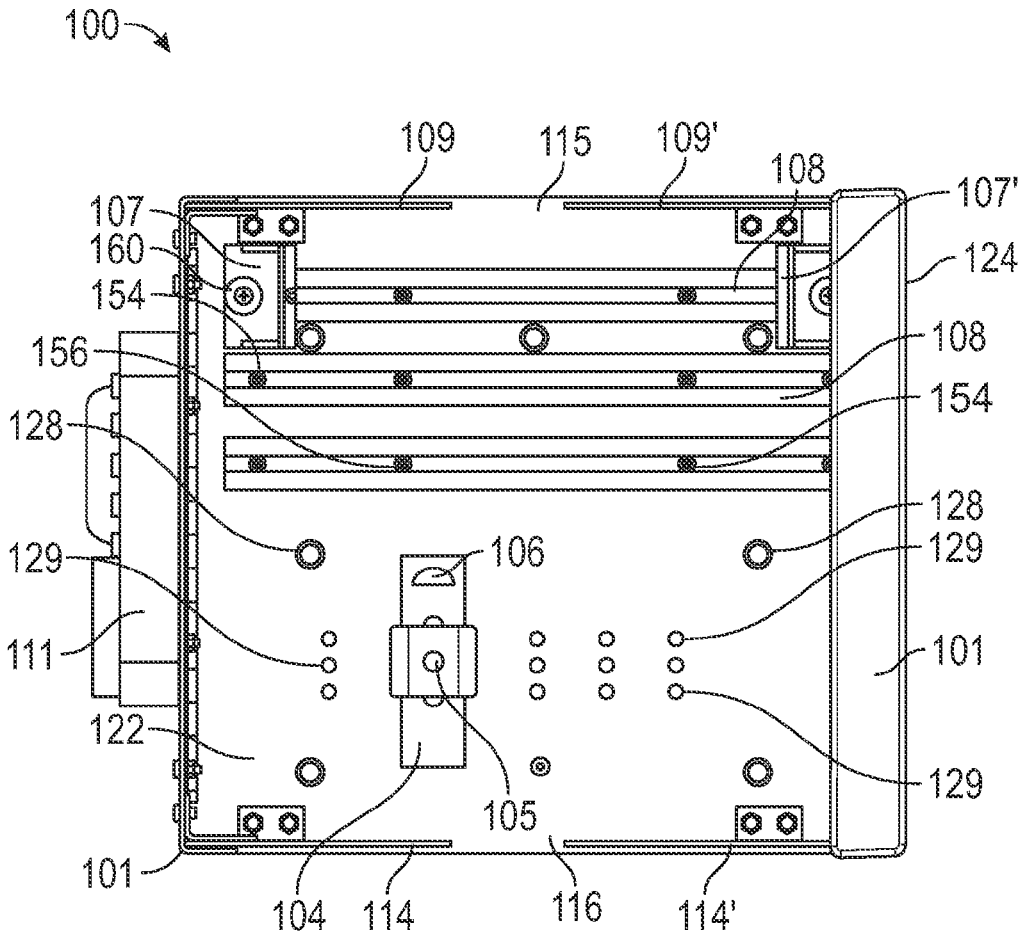
FIG. 1B is a front view of an apparatus according to the present disclosure (as it may appear in use upon a vertical mounting surface, which is not shown), with the door assembly in an open condition to expose certain components of the apparatus within the housing interior.

Referring specifically to FIG. 1B, the housing back 122 is penetrated by a plurality of holes. At least two (preferably more) housing mounting holes, e.g., mounting holes 128, are provided through the back 122 for securely (and at least semi-permanently) mounting the main housing 101 to a mounting surface, such as a building wall or heavy door, by means for example of lag bolts, or other bolts, heavy duty screws, etc.

The apparatus 100 includes a locking assembly comprising means for releasably locking the door assembly 102 in the closed position, and by which the door assembly 102 can be locked and unlocked in respect to the main housing. In the closed position, the door assembly is brought into contact with the wall (i.e., 124) that does not mount the hinge 120. The means for releasably locking includes a moveable bolt or latch 135 on/in the door assembly 102 (e.g., on the inside of the door); the latch is of a generally conventional configuration, and in this means is controllably movable to and fro to engage and disengage with a suitable recess or catch defined on or in a housing wall (i.e., wall 124), when the door assembly is in the closed position, generally according to convention in the art.

The engagement/disengagement of the latch 135 from its confronting wall recess or catch (e.g., strikeplate or socket), to permit the door assembly to swing to an open position, is regulated in the preferred embodiment by an electromechanical locking/unlocking control mechanism. The locking control mechanism may be, for example, a door lock key pad 111 on the outside of the door assembly 102. The latch 135 and door lock key pad 111 may be assembled as a single electromechanical unit disposed on/though the door assembly. The door lock key pad 111 is, in one possible embodiment, an electrically operated (e.g., battery powered) locking control which accepts a predetermined key code (by a manual keypad interface) to allow silent access to the interior of the housing 101 when the door assembly 102 is in the closed position. Upon the user's entry of the proper key code on the pad 111, the latch 135 is mechanically withdrawn to disengage it and allow the door assembly 102 quietly to open. Suitable electronic keypad and electrically operated latch units are available commercially from Zephyer Lock, LLC, under the brand name Zephyer®, as Model Nos. 2054, 2154, or 2254. An optional but preferable battery-powered LED key pad light 110 is provided on the outside of the door assembly 102 to facilitate operation of the keypad 111 and access to the apparatus 100 interior in conditions of near or total darkness. Alternatively, the locking control mechanism, such as the keypad, may be self-illuminating. When used, the keypad light 110 as is placed in proximity to the door lock key pad 111. The keypad light 110 may be a commercially available infrared sensor light (with four LEDs) auto PIR (passive infrared) wireless keyhole motion detection light, such that the proximity and/or motion of a user's fingers automatically activates the LED light 110 to illuminate the keypad 111 for a period of time.

It is to be understood that the use of a keypad 111 in the locking/unlocking control mechanism is but an example of one preferred embodiment of a locking control means. The locking mechanism including a latch 135 (or any other suitable type of movable bolt or other means for locking) alternatively may be controlled and actuated using conventional metal keys, or other more sophisticated locking control means. Alternative locking actuation and control means include, for example, keycards, such as mechanical hole-punched cards, bar coded cards, magnetic stripe cards, Wiegand wire embedded cards, smart cards (embedded with a read/write electronic microchip), or radio-frequency identification (RFID) proximity cards. Very personalized locking control may be provided using biometric actuation and control means, including fingerprint detection, retinal scans, or voice identification actuation means.

Figure 2:
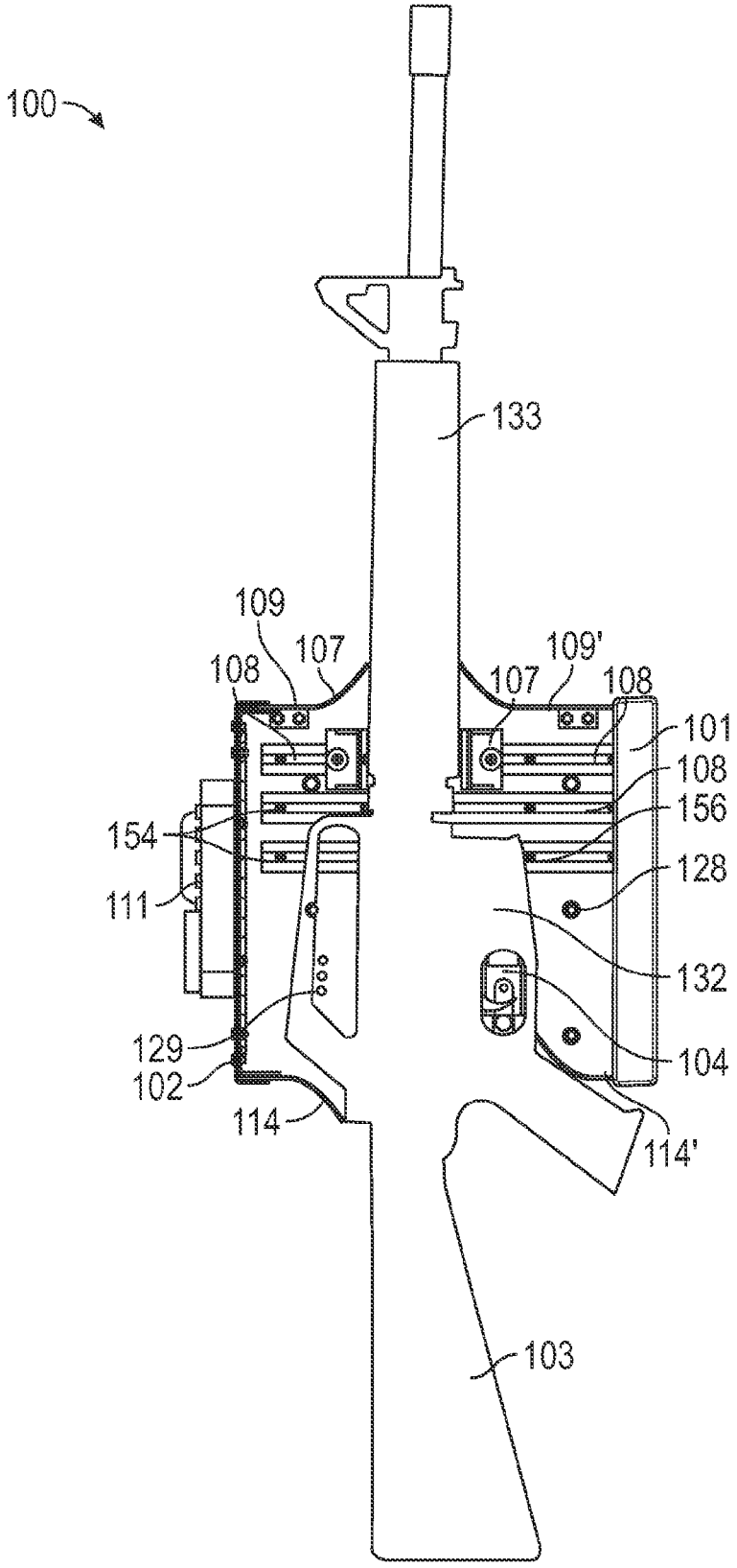
FIG. 2 is a front view of an apparatus according to the present disclosure, showing the door assembly open and an AR-15 rifle in place, suspended by the adjustable trigger guard support assembly, the rifle also held by the forward support mechanism with side clamp members positioned along one of three clamps tracks, and with upper and lower access inhibitors at the top and bottom of the apparatus.

FIG. 2 is a front view of a preferred embodiment of the security apparatus 100 as it would appear in use, for example, as mounted upon a vertical supporting surface and with the door assembly 102 open 90°. An AR-15 rifle 103 is shown situated in the security apparatus 100 in accordance with a practice of the present invention. The AR-15 rifle 103 is shown by way of example only, and is intended to be representative of any number of models or varieties of firearms (particularly long guns) which may be situated in the same manner within the apparatus 100. Nearly all rifles and shotguns have a trigger guard 132 and forestock 133. As suggested by FIG. 2, the trigger guard 132 and forestock 133 are the portions of the long gun 103 which primarily releasably engage with the security apparatus 100.

Figure 3:
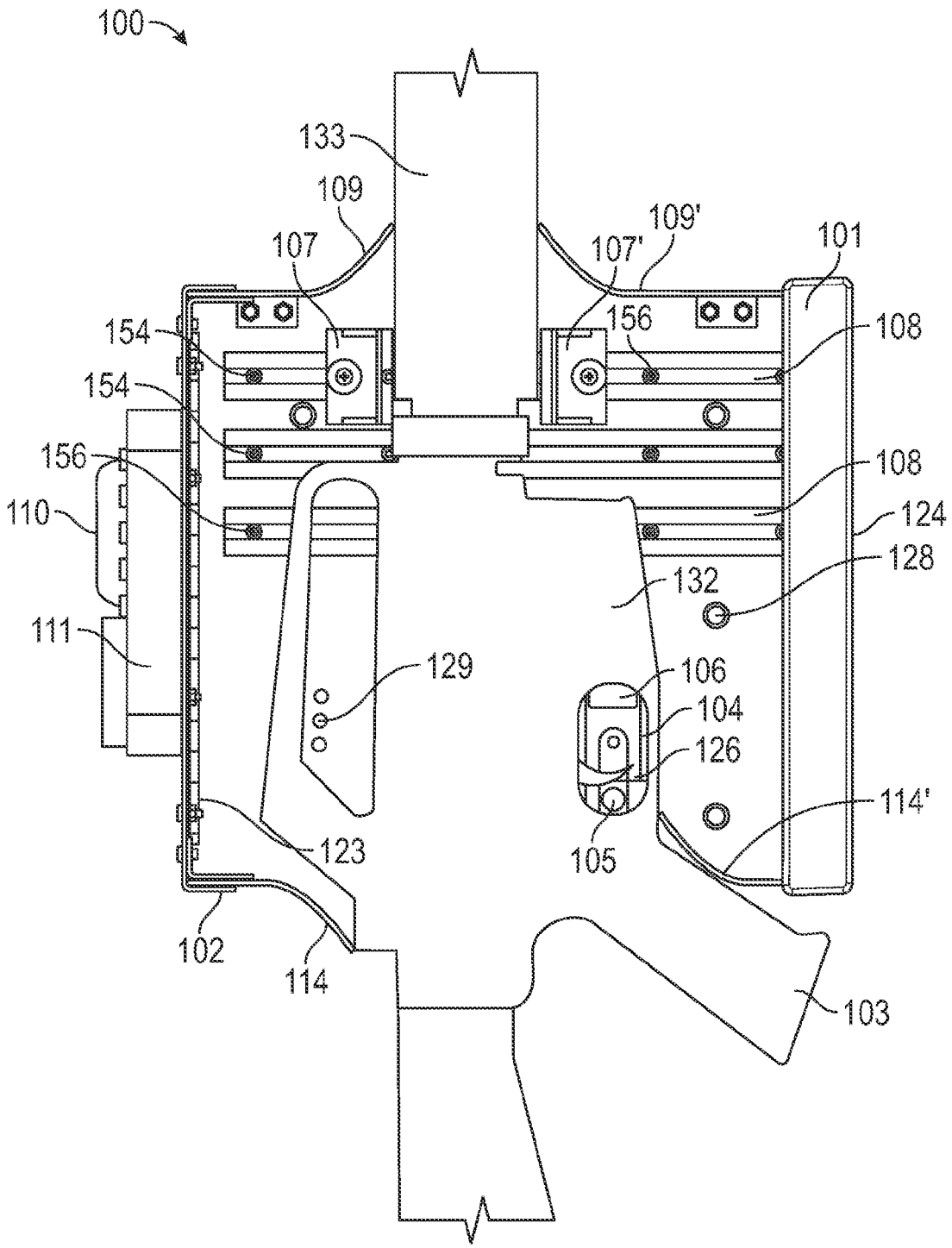
FIG. 3 is an enlarged view of the apparatus of the present disclosure seen in FIG. 2, illustrating certain components of the apparatus and their engagement with the rifle.

A preferred embodiment of the upper supporting assembly features a single clamps track 108 adjustably locatable within the housing, with a pair of side clamp members 107, 107' movable thereon. FIGS. 1A-C, 2 and 3 illustrate that there is at least one, possibly a plurality, of clamps tracks 108. When the back 122 of the security apparatus 100 is mounted upon a vertical surface, the clamps track(s) 108 preferably is approximately horizontal. As best seen in FIGS. 2 and 3, where there is a plurality of clamps tracks 108, the tracks preferably are substantially parallel. In one embodiment, the housing back 122 is penetrated with an array of track mounting holes by which the one or more clamps tracks 108 are attachable in the housing interior, by means, in this example, of screws extending through the track mounting holes and into the housing interior. The clamps tracks 108 have defined therein corresponding track attachment apertures 154 (see also FIG. 7) which are alignable with the track attachment screws extending from the back 122. Track attachment nuts 156 are threadably engagable with the track mounting screws and can be tightened against the clamps track 108 to secure the clamp track in a use position within the housing 101. The track mounting holes in the housing back 122 preferably are arranged in rows, so that the vertical positions (FIG. 2) of the one or more clamps tracks 108 are selectively adjustable. Thus, the vertical position of a clamps track 108 (e.g., relative to the access inhibitors 109, 109', 114, 114' at the top and bottom of the housing) can be changed by detaching the clamps track from the back 122 by unscrewing the associated track mounting nuts 156, relocating the clamps track to a different row of track mounting holes, aligning the track attachment apertures 154 (in the clamps track) with the different row of track mounting holes, and then re-attaching the clamps track 108 to the housing with track attachment screws and tightened track mounting nuts. The clamps track 108 accordingly is movably attachable at any of a plurality of positions selectively to adjust a clamps track assembly separation distance between the clamps track and at least one of the access inhibitors. A complete upper supporting assembly featuring a single clamps track 108 and a pair of side clamp members 107, 107' is described further hereafter, with reference to FIG. 7.

Referring again to FIG. 1B, there is defined an array or series of regularly spaced trigger guard assembly mounting holes 129. These mounting holes 129 offer one means by which a trigger guard support assembly 104 is movably attachable to the back 122 at any of a plurality of positions within the housing interior. The plurality of trigger guard assembly mounting holes 129 accept any of a plurality of screws (not shown) which extend forward into the housing interior, and by which a trigger guard support assembly 104 (seen in FIGS. 1A-C, 2 and 3, and detailed in FIG. 6) preferably is movably positionable for use at different selected locations (up and down vertically, and/or right-to-left horizontally) within the housing 101 of the assembly 100. By selectively disposing screws through the back 122 and through the trigger guard support assembly 104, and releasably securing (e.g., with nuts or lock nuts on the screws) the trigger guard support assembly with the screws and nuts, the trigger guard support assembly 104 is movably attachable to the housing back 122 at any of a plurality of positions within the interior of the housing 101.

Figure 1C:
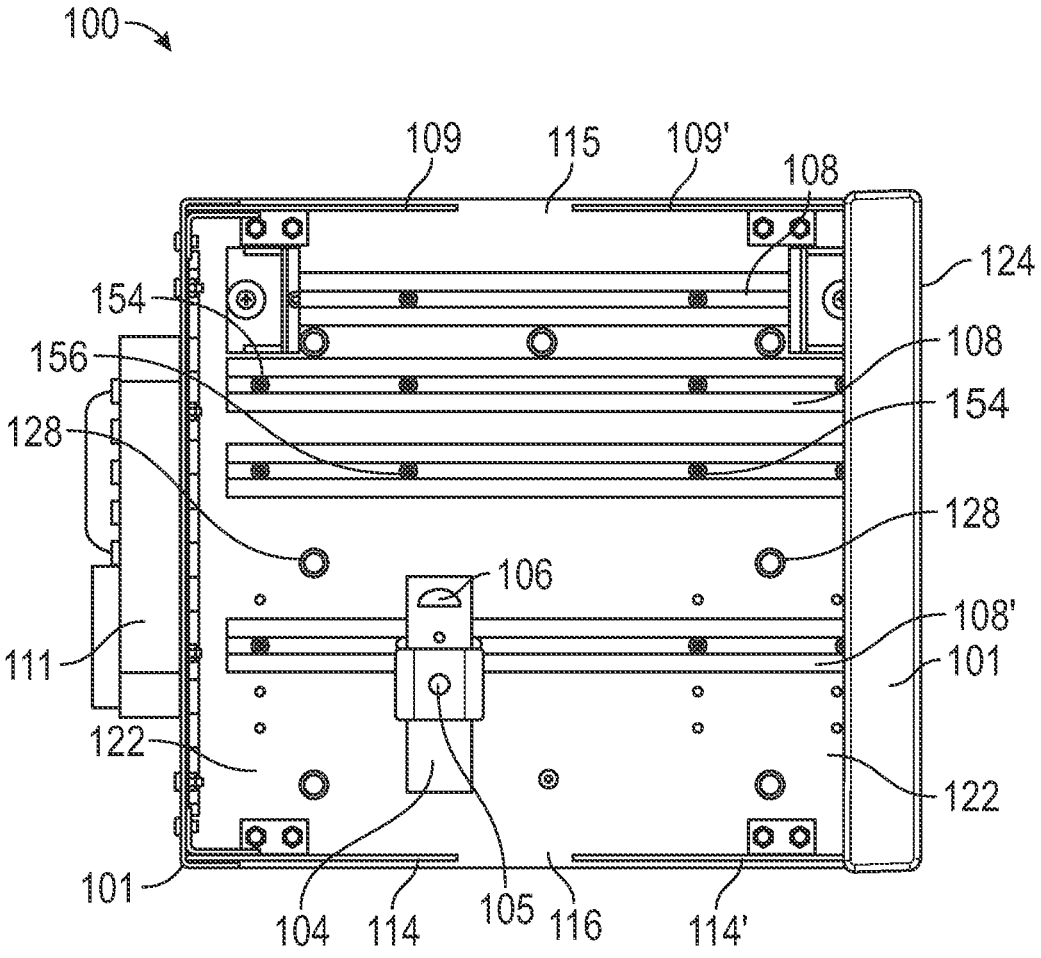
FIG. 1C is a front view, similar to the view of FIG. 1B, of an apparatus according to the present disclosure, with the door assembly in an open condition to expose a preferred alternative means for movably mounting the trigger guard support assembly upon the back of the housing.
Figure 1D:
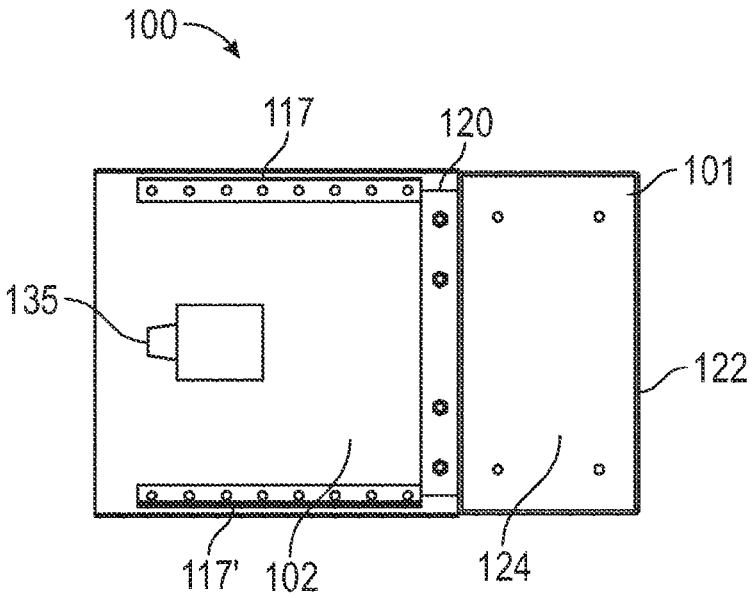
FIG. 1D is a right side view of the apparatus according to the present disclosure as seen in FIGS. 1B and 1C, with the door assembly in an open condition to reveal certain components on the interior side of the door.
Figure 1E:
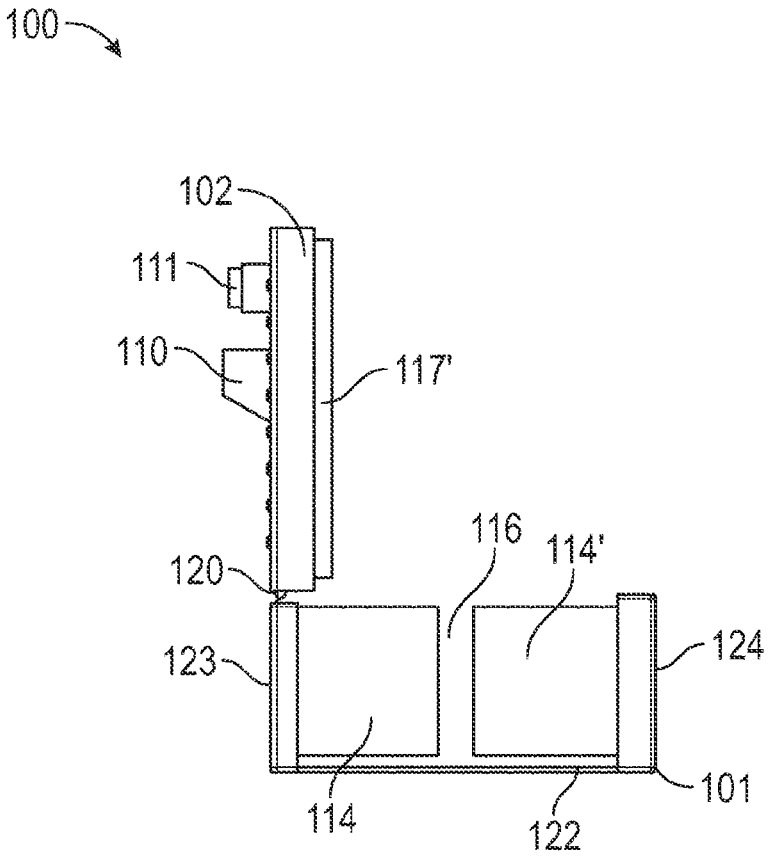
FIG. 1E is a bottom view of the apparatus according to the present disclosure as seen in FIGS. 1A-C, with the door assembly in an open condition.

Attention is invited to FIG. 1C, illustrating a preferred alternative means by which the trigger guard support assembly 104 may be movably attachable to the back 122 at any of a plurality of positions within the housing interior. The trigger guard support assembly 104 is depicted in detail in FIG. 6. There may be provided a support assembly track 108' substantially similar in form and function to a clamps track 108 upon which the side clamp members are movably disposed, as mentioned previously above. The support assembly track 108' is removably/adjustably attachable to the housing back with suitable apertures in the back and screw/nut combinations disposed through the track 108' and the back 122. The support assembly track 108' preferably is securely (but removably) fastened in a horizontal alignment as seen in FIG. 1C. The trigger guard support assembly 104, more specifically the trigger guard base member 126, may be selectively movable along (i.e., to or fro, right or left, in FIG. 1C), and releasably connected to, the track 108'. The slidable connection of the track 108' may be by any suitable means, such as one or more threaded pins through the support assembly 104 and engaged with the support assembly track 108'; a screwed pin and slot engagement similar to that used to movably attach the side clamp members 107 to the clamps track 108 may be employed, to which reference is made to FIG. 7 for additional instructive detail. By manually selectively tightening and loosening a threaded pin engagement, or other mode of releasable connection, between the trigger guard support assembly 104 and the track 108', the trigger guard support assembly can be released from secure connection at one location along the track 108', selectively moved along the track to a desired second location on the track, and then releasably re-secured in position at the second location. Such adjustability in the location of the trigger guard support assembly 104 upon the support assembly track 108' further promotes the versatility of the security apparatus 100 to receive and hold a wide variety of firearms.

FIG. 3 shows the security apparatus 100 with the door 102 in the open position and a representative long gun 103 in situated therein. Reference to FIG. 3 offers information regarding how a firearm 103 may be placed into the apparatus 100 for storage. The long gun is supported in part upon the trigger guard support assembly 104, which includes a trigger guard base member 126 and a trigger guard support 106. The long gun 103 rests directly on the trigger guard support 106, which extends perpendicularly away from the trigger guard base member 126 that is movably, but reliably, attached to the housing back 122. In a preferred embodiment, the trigger guard support 106 is securely fixed to the trigger guard base member 126, and thus is immobile in relation to it. Also in a preferred embodiment, the trigger guard support assembly 104 includes a trigger safety pin 105 that is movable in relation to the trigger guard base member 126. When the security apparatus 100 is used typically, an interior surface of the firearm's trigger guard 132 rests upon the trigger guard support 106. A trigger safety pin 105, which also extends in a direction perpendicular to trigger guard base member 126, lands behind the trigger of the firearm 103. The trigger safety pin 105 may come into contact with the back (i.e., lower in the figure) portion of the firearm's trigger guard, insuring that any vertical movement (particularly upward movement) of the weapon 103 while still within the security apparatus 100 will not actuate the firearm's trigger (as the trigger otherwise could be depressed by the trigger guard support 106). Referring jointly to FIGS. 1B, 1C, and 3, it is observed that the trigger guard support assembly 104 preferably is oriented substantially vertically within the housing interior, with the trigger guard support 106 situated above the trigger safety pin 105. In a preferred embodiment, the lower trigger safety pin 105 is selectively movable linearly up and down, thus allowing the trigger safety pin to be positionable (by the sliding of the carriage 144 bearing the pin 105, see FIG. 6) upon the trigger guard base member of the support assembly 104. This movement of the trigger safety pin permits an adjustment of the trigger pin distance between the trigger guard support 106 and the trigger safety pin 105. When a desired trigger pin distance has been selected by the user, the carriage 144 (FIG. 6) can be releasably secured in position to temporarily fix the trigger pin distance.

Referring to FIG. 3, the horizontal side clamp members 107, 107' which are on a horizontal clamps track 108 in the upper portion of the housing 101, are disposed one on either side of the gun 103 after the rifle or shotgun is centered in the apparatus 100. At least one, preferably both, side members 107, 107' are adjustably positionable (e.g., side-to-side), as by sliding engagement, with and upon the clamps track 108. The side members 107, 107' are adjusted in close proximity to the gun 103 (e.g., the forestock 133) to hold it substantially vertical, and to support it against rotation around the trigger guard support 106. Moreover, and as illustrated further with reference to FIG. 7, one or both side clamp members 107, 107' preferably are rotatable about an axis perpendicular to the clamps track 108, allowing the clamp member(s) 107 and/or 107' to pivot in position relative to the gun 103 (e.g., the forestock 133), to better adapt the orientation of the clamp member(s) to the gun's profile.

After the desired firearm position is achieved in relation to the trigger guard support 106, one or both side members 107, 107' may be slidably moved to positions for holding the firearm 103 (normally by gently contacting opposite sides of the forestock 133). The side clamp members 107, 107' may be padded on their respective faces which contact the firearm 103. Once placed into their selected firearm holding position(s), the side clamp members 107, 107' may be selectively locked or tightened in place by means of screws or other hardware, as shall be described further.

Also seen in FIG. 3 are the access inhibitors 109, 109', 114, 114' which serve to discourage or prevent access to the housing interior from the top or bottom, and yet which permit the security apparatus 100 to be adapted to receive firearms of differing shapes, contours, and sizes, and/or firearms equipped with an accessory such as a telescopic sight. In a preferred embodiment, upper access inhibitors 109, 109' are provided at the top of the housing 101, on either side of the firearm's upper portion (e.g., forestock 133). Similarly, lower access inhibitors 114, 114' preferably are provided at the bottom of the housing 101, on either side of an intermediate or lower portion (e.g., the long gun's receiver, as seen in FIG. 3, or perhaps its butt stock). The access inhibitors 109, 109', 114, 114' may have any of a variety of forms, but in the preferred embodiment comprise two pairs of very stiff yet mildly flexible plastic flaps. There is an upper pair of flaps 109, 109' (one each on either side of the firearm 103), and a lower pair of flaps 114, 114', one each on either side of the firearm. In the preferred embodiment seen in the figures, two of the access inhibitor flaps 109 and 114 are securely attached to the first wall 123 near the top and bottom of the housing 101, respectively. The other two flaps 109' and 114' are securely attached to the second wall 124 near the top and bottom of the housing 101, respectively. Attachment of the flaps to the main housing 101 may be by means of screws, rivets, or the like.

More particularly, and referring especially to FIG. 3, there is a first access inhibitor 109 extending a first length from the first wall 123 toward the second wall 124, and a second access inhibitor 109' associated with the first access inhibitor 109 and extending a second length from the second wall 124 toward the first wall 123. The first and second access inhibitors 109, 109' define a first gap 115 (labeled in FIGS. 1A, 1B, 1C, and 4A) between their interior ends. There also is a third access inhibitor 114 extending a third length from the first wall 123 toward the second wall 124, and a fourth access inhibitor 114' associated with the third access inhibitor 114 and extending a fourth length from the second wall 124 toward the first wall 123. The third and fourth access inhibitors 114, 114' define a second gap 116 (see FIGS. 1A-C, 1E, 4A and 4B) between their interior ends.

As mentioned, the access inhibitors 109, 109', 114, 114' of the preferred embodiment of the apparatus 100 are comprised of thin (e.g., 0.0625 inch (2.0 mm)) sheets of moderately stiff, generally unbreakable, yet elastically bendable, polymer or plastic. The effective length (in a dimension perpendicular to a housing wall 123 or 124) of each one of the access inhibitors 109, 109', 114, 114' is adjustable in either, or both, of two ways. First and most preferably, any access inhibitor, preferably being composed of plastic, may be cut or trimmed (e.g., while temporarily detached from the housing 101) to shorten its length (i.e., lateral length side to side as seen in FIG. 1B). (Each flap preferably is attachable/detachable to/from its respective side wall (123, 124) by means of a screwed connection or similar.) Thus a user may shorten the extent (length) of any one or more, or all, the access inhibitors 109, 109', 114, 114' by cutting a strip from its/their lateral inward edge(s), thereby to increase the lateral extent of the first and/or second gaps 115, 116 when the inhibitors are secured to corresponding walls 123, 124. Thus, the lateral extent or size of either or both gaps 115 and 116 can be adjustably customized to the lateral profile of the firearm to be stored in the apparatus 100. After evaluating the size relation between the firearm profile and the initial size of the gap 115 and/or 116, the user selectively cuts away an inner portion of one or more of the access inhibitors 109, 109', 114, 114' to adapt the dimension of a gap 115 and/or 116 to the firearm profile.

Also, the plastic flaps additionally or alternatively are sufficiently flexible such that they can bend upward or downward a modest amount, if necessary, to accommodate the presence of a firearm 103 as seen in FIGS. 2 and 3. Thus, if needed, the lateral extent of a first gap 115 (or second gap 116) can be increased by shortening the effective length (in the direction perpendicular to its associated housing wall) of either or both of its associated flaps 109, 109' (or 114, 114') by bending the flap(s) upward or downward. By way of example, a long gun 103 can be situated in the apparatus 100 by the mode of inserting the gun into the gaps 115, 116 by bending the inside edges of access inhibitors 109, 109', 114, 114' upward or downward as needed, causing the access inhibitors 109, 109', 114, 114' temporarily to be non-planar curved sheets, thereby to accommodate the width of the gun. Typically but not necessarily, the upper flaps 109, 109' are resiliently bent upward, while the lower flaps 114, 114' are bent downward. It may be preferable when possible to have all four flexible inhibitors 109, 109', 114, 114' bend outward away from the housing interior, which may enhance security against unauthorized access. With the gun in place, the elastic resiliency of the flaps 109, 109', 114, 114' may cause the inside edges of the flaps to rest gently against surfaces of the gun (FIGS. 2 and 3); preferably, the access inhibitor flaps are cut to a length such that only minimal bending thereof is needed to accommodate a selected firearm profile. When the gun is removed from the apparatus 100, the flaps elastically rebound to their planar rest condition(s) perpendicular to the side walls (as seen, for example, in FIG. 1A). From the foregoing, it is seen that at least a first length of one of a first pair of access inhibitors (i.e. upper flap 109 or 109') is changeable to adjust a dimension of the first gap 115, and at least a third length of one of the other pair of access inhibitors (114 or 114') is changeable to adjust a dimension of the second gap 116. Notwithstanding the modest flexibility of the inhibitors 109, 109', 114, 114', it is contemplated that the principle mode for changing the length(s) of the inhibitors is that of trimming or cutting them, thereby to adjust the dimension(s) of the gaps; the access inhibitors should be sufficiently stiff so as to form practical barriers to unauthorized entry into the apparatus interior while in use.

Accordingly, at least the first length of a first access inhibitor 109 as it extends from the first wall 123 is changeable (by cutting or bending) to adjust a dimension of the first gap 115, and at least a third length, that is, the length of the third access inhibitor 114 as it extends from the first wall 123, is changeable (by cutting or bending) to adjust a dimension of the second gap 116. Additionally or alternatively, the length of a second access inhibitor 109' (e.g., as extending from a second wall 124) is changeable (by cutting or bending) to adjust a dimension of the first gap 115, and the length of a fourth access inhibitor 114' (as extending from a second wall 124) is changeable (by cutting or bending) to adjust a dimension of the second gap 116. A length of one or more of the access inhibitors thereby is changeable to adjust a dimension of either or both the gaps, e.g., so that a lateral dimension of a gap corresponds to, or is slightly less, than the lateral dimension of the portion of the firearm disposed into the gap 115 or 116. According to the practice of the invention, when the apparatus is in use the gap lateral dimension preferably is smaller than, or at most about equal to, the lateral extent of the corresponding portion of the firearm filling the gap.

As best seen in FIGS. 1A, 1E, 4A, and 4B, the door assembly 102 preferably includes top and bottom flanges that extend perpendicularly from the top and bottom edges of the door assembly. It is readily understood that when the door assembly is in the fully closed position, these door flanges extend in the direction of the back 122 of the apparatus 100. In one preferred embodiment of the security apparatus 100 the door assembly flanges and the access inhibitors 109, 109', 114, 114' overlap (without necessarily being in actual contact) when the door assembly 102 is in the closed position. Particularly when the inhibitors flaps 109, 109', 114, 114' are well-trimmed to be customized to a particular firearm, the closing of the door apparatus 102 brings the door flanges into a substantially parallel relation to the access inhibitors; in such circumstance, the inhibitors preferably are situated inside (i.e., slightly closer to the housing interior) the door assembly flanges. The flanges thus enhance apparatus security by discouraging tampering with the inhibitors flaps 109, 109', 114, 114' (for example by pulling them down/up away from the apparatus interior) when the door assembly 102 is in closed position on the housing 101.

Alternative embodiments of the access inhibitors 109, 109', 114, 114' are within the scope of the invention. For example, in lieu of bendably flexible flaps, each access inhibitor may comprise an aligned series of individual, independently removable, rigid, substantially unbreakable access inhibitor tabs as seen in our U.S. Provisional Patent Application No. 61/954,097 incorporated herein by reference. Such access inhibitor tabs are selectively arranged on either side of the firearm upper portion and the firearm lower portion, and are mechanically removably coupled along the top and bottom of the main housing assembly by means of screws or rivets or other associated hardware. The access inhibitors, especially the bendable flaps embodiments thereof, preferably are removable so that a new replacement set of inhibitors, having different effective lengths, can be attached to the housing to adapt the gaps 115, 116, to a different firearm.

Figure 4A:
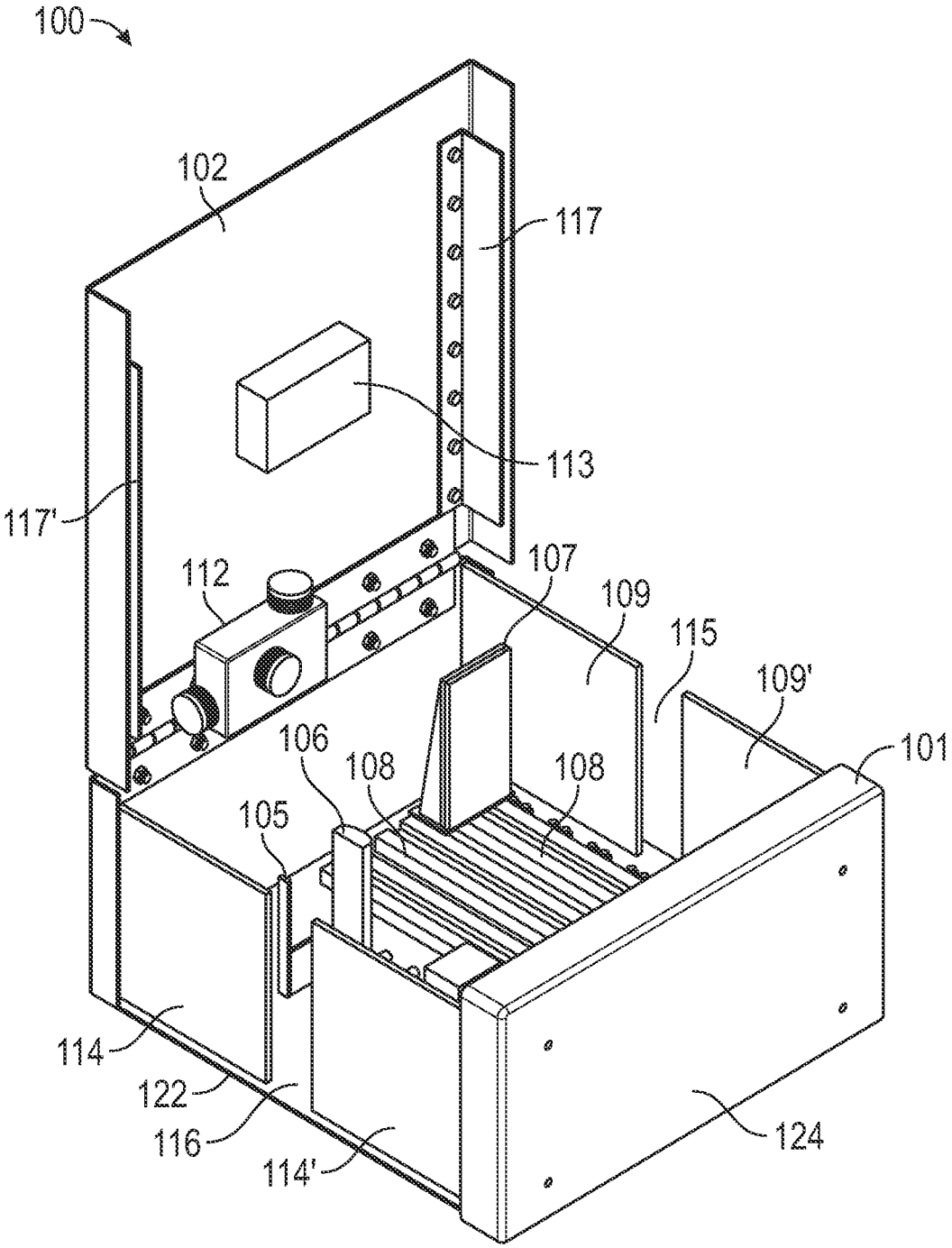
FIG. 4A is a perspective front view of an apparatus according to the present disclosure, showing certain interior features of the apparatus and the optional use of a support block assembly, and the optional use of a firearm cushion member, upon the inside surface of the door assembly.

Security of the apparatus interior also may be increased by optional but preferable door flaps 117, 117' attached on the inside of the door assembly 102 (or on the insides of the door flanges) as seen by way of example in FIGS. 1A, 1D, 1E, and 4A. The door flaps 117, 117' may be composed of material similar or even identical to that of the access inhibitors 109, 109', 114, 114', e.g., a very stiff but elastically flexible plastic. The door flaps 117, 117' serve a purpose similar to that of the access inhibitors 109, 109', 114, 114', that is, to prevent unauthorized access to the housing interior. The door flaps 117, 117' are attached to the inner side of the door assembly so to extend a short distance into the interior when the door assembly is closed. As seen in FIGS. 1A and 4A, the door flaps 117, 117' extend from respective upper and lower flanges or edges of the door assembly 102; when the door assembly is pivoted toward or to the closed position, the flaps 117, 117' are brought nearly into alignment with the access inhibitors 109, 109', 114, 114'. The door flaps 117, 117' may bend or flex, as needed, in response to their pressed contact with the firearm when the door assembly is closed. With the door assembly closed against the housing assembly, the door flaps 117, 117' overlap with or nearby the access inhibitors 109, 109', 114, 114' to discourage intrusions into the top or bottom of the housing 101.

Figure 4B:
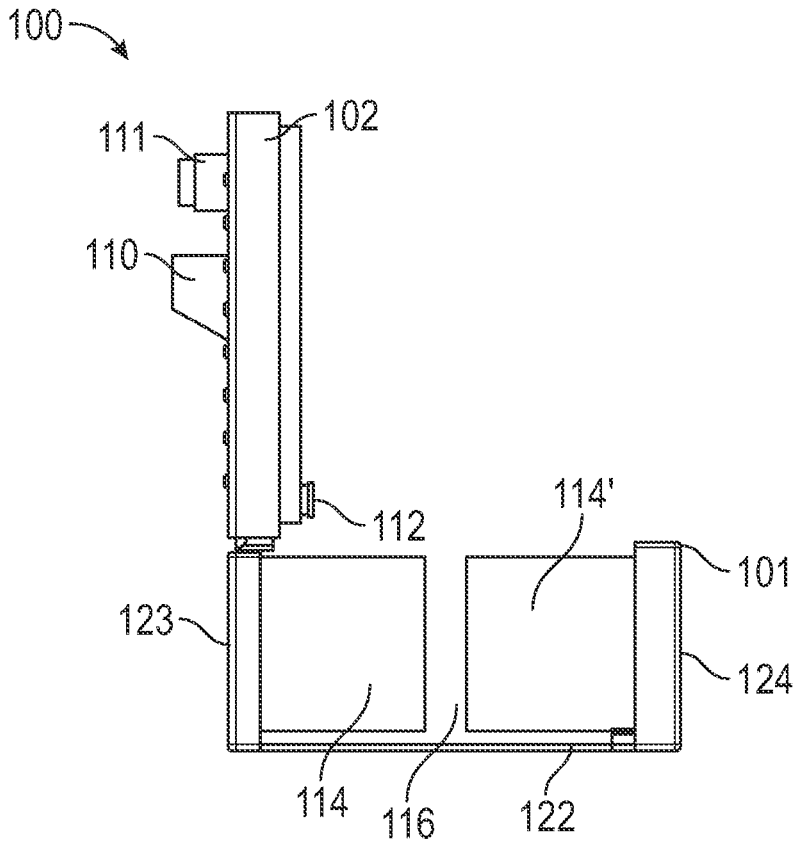
FIG. 4B is a bottom view of the apparatus shown in FIG. 4A, also showing the optional use of a support block assembly on the inside of the door assembly, and the second gap between the lower (third and fourth) access inhibitors.

Reference is made to FIGS. 4A and 4B. The FIG. 4A is an isometric view, and FIG. 4B a bottom view, of an embodiment of the security apparatus 100 with the door assembly 102 in the open condition to show the situation and use of an optional support block assembly 112. The support block assembly 112 is attached to the inside of the door 102 at a selected appropriate location. The support block assembly 112 optionally but preferably pushes gently against the body of a firearm that is within the apparatus housing 101 (FIG. 3). The support block assembly 112 moves with the door assembly 102, such that when the door assembly is pivoted into the closed position, the support block assembly (which may be padded) moves into contact with a surface of the firearm, and thus gently but firmly presses the firearm against the inside of the back 122 of the housing 101. In effect, therefore, the firearm 103 is gently clamped, front-to-back, between the support block assembly 112 (of the door assembly 102) and the housing back.

Additionally or alternatively, an elastically compressible foam block or other resilient cushion member 113 may optionally be affixed (e.g., by adhesive or the like) to the interior of the door 102. The cushion member 113 is so located and provided with such a thickness as to apply a conformal force against the body of the firearm when the door assembly is closed. Its location and thickness can be predetermined so to be customized to the particular firearm to be stowed in the security apparatus 100. Thus, in like manner as the support block assembly 112, the cushion member 113 in use holds the rifle or shotgun in proper position within the apparatus 100 with a mild clamping action after the door 102 is closed and locked.

Figure 5:
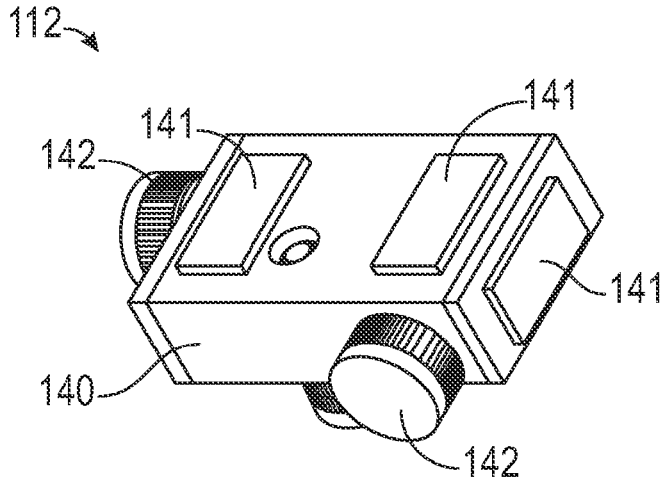
FIG. 5 is an enlarged perspective view, in isolation, of the support block assembly seen in FIGS. 4A and 4B.

Additional details regarding the optional support block assembly 112 are provided with reference to the isometric enlarged view of FIG. 5. In a preferred embodiment, the support block assembly 112 is composed of a nonferrous metal or durable plastic body 140 which has a three-dimensionally asymmetrical shape, e.g., an oblong rectilinear box having a length dimension different from its width and also different from its height. The different three dimensions of the body 140 allow it to be placed on the interior of the door 102 (e.g., FIG. 4A) to present a selectable assembly thickness (i.e., dimension perpendicular to the door), in order that the assembly 112 occupy the maximal measure of the gap between (1) the profile of the weapon being secured, and (2) the interior surface of the door 102. A plurality of magnets 141—preferably one magnet on each surface of the support block body 140, and vary preferably there being provided a magnet 141 on at least three orthogonally different surfaces of the assembly—removably attach the support block assembly 112 at any selected location on the inside of a ferrous metal door 102 (or to a ferrous metal contact affixed to a composite or durable plastic door). Continued reference to FIG. 5 shows that threaded knobs 142 are intended to adjustably occupy any remaining gap between the firearm and the door 102. The knobs 142, which preferably are padded on their tops, can be controllably screwed into and out of corresponding threaded taps in the block assembly body 140. Manual manipulation of a knob 142 thereby can adjust its profile extension above the housing 140, thereby to apply pressure to a specific portion of the stowed weapon to maintain firm pressure on the weapon after the door 102 is closed and locked. Because the support block assembly 112 can be oriented to present any of at least three effective thicknesses extending from the inside of the door 102, and can be magnetically attached at nearly any selected location on the interior of the door, it does not interfere with the locking mechanism 135, and yet allows for almost any standard thickness of weapon to be accommodated and clamped by adjusting the threaded knobs 142 as they are screwed in or out of the housing 140 to conform to the required weapon dimension.

Figure 6:
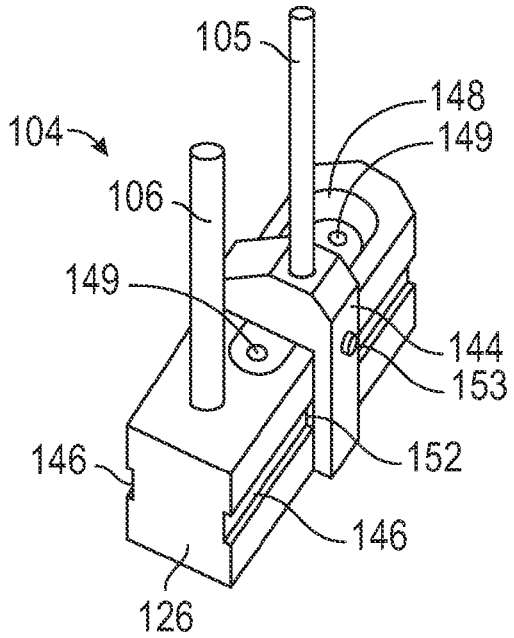
FIG. 6 is a top front perspective view, in isolation, of a possible embodiment of a trigger guard support assembly of the apparatus, which assembly is adjustably positionable within the housing of the apparatus.

Attention is invited to FIG. 6, providing an enlarged isometric view of the trigger guard support assembly 104, viewed in isolation. The trigger guard support assembly 104 has a trigger guard base member 126 composed of machined aluminum, or other metal alloy, or a durable molded plastic, or a composite. In a possible embodiment, there is an adjusting groove 148 defined longitudinally in the front of the base member 126. Defined through the back of the adjusting groove 148 and fully penetrating the trigger guard base member 126 are at least two trigger guard base member mounting holes 149. Screws (preferably at least two, not shown) are passed through the trigger guard assembly mounting holes 129 (FIG. 1B) in the back 122 of the housing 101 to extend forward into the housing interior; the screws are aligned with and pass through the guard base member mounting holes 149. Nuts (not shown) are conventionally threaded onto the screws and tightened to releasably yet securely attach the base member 126 to the inside back of the housing 101. By selecting ones (e.g. one of the pairs) of trigger guard assembly mounting holes 129 in the housing back 122, a user can choose a position (in the housing interior) for the trigger guard support assembly 104 that is best adapted to the profile, size, and shape of a firearm to be secured. Accordingly, the trigger guard base member 126 is movably attachable at any of a plurality of positions within the housing interior, thereby selectively to adjust a base member separation distance between the trigger guard base member 126 and at least one of the housing walls 123 or 124. As previously explained, the trigger guard support assembly 104 may be adjustably positionable on the interior back 122 of the housing by other suitable means, including being slidably positionable and releasably securable along a base track member 108, as seen in FIG. 1C, and substantially similar to the adjustable means described herein with reference to the clamps 107, 107' and clamps track 108.

By providing an extensive yet predetermined array of trigger guard assembly mounting holes 129 in the back of the housing, the versatility of the securing apparatus 100 is significantly increased because the location of the trigger guard support assembly 104 is selectable by the user. The trigger guard base member 126 can be moved up and down, and/or right to left, to place it in the most customized location within in the housing 102, as best to accommodate the trigger guard location/configuration of the firearm of interest. Should the user desire to use the apparatus 100 to secure some other firearm, the nuts can be removed, and screws used with different ones of the trigger guard assembly mounting holes 129 and passed though the guard base member mounting holes 149, to re-attach the trigger guard base member 126 at a different, more firearm model-specific, location within the housing 101. Again, in a preferred embodiment, the trigger guard base member 126 (with its base member mounting holes 149) can be repeatedly detached and relocated, laterally/horizontally and/or vertically, upon the pattern of trigger guard assembly mounting holes 129, to optimize its location within the housing 101 relative to the trigger and trigger guard of the firearm of interest.

Continued reference to FIG. 6 illustrates how in one preferred embodiment of the apparatus 100, the trigger safety pin 105 is adjustably positionable upon the trigger guard base member 126. The trigger safety pin 105 is securely fixed to, and extends forward (preferably generally perpendicularly) from, a carriage 144. The carriage 144 is slidably engaged with the trigger guard base member 126. The trigger safety pin 105 is a rigid metal or composite material member, generally immobile with respect to the carriage 144. The trigger safety pin 105 preferably may be a machined aluminum dowel having a cylindrical shape, although it may also define a semi-cylinder, or any other suitable cross-sectional shape, and optionally may be padded where it contacts the inside of a firearm's trigger guard.

The position of the trigger safety pin 105 preferably is adjustable linearly relative to the base member 126. The trigger guard base member 126 may have longitudinal carriage channels 146 defined in its sides. A sliding engagement between the carriage 144 and the trigger guard base member 126 connects the carriage to the base member to prevent them from being readily separated, and yet allows the carriage to be controllably moved longitudinally up and down on the base member 126. One or more carriage set screws 153 pass through threaded holes in the carriage 144 so that their distal ends can be screwed into contact with the underlying side of the base member 126. The carriage 144 has pins 152 or other protruding elements therein/there through (or thereon) which extend from the inside of the carriage and into the carriage channels 146. (The left side of the carriage 144 is substantially the same (but in opposite orientation to) its right side seen in FIG. 6.) The pins or other members 152 correspond with the carriage channels, and hold the carriage 144 and base member 126 together while yet permitting the carriage to slide up and down (parallel) relative to the base member. After the carriage 144 has been moved to a desired location on the trigger guard base member 126, its position can be temporarily established by screwably turning one or more set screws 153 or the like into securing contact with the side(s) of the trigger guard base member 126. It seen therefore that the position of the carriage 144, and thus of the trigger safety pin 105, in relation to the base member 126, is selectively adjustable by releasing the set screws 153, sliding the carriage along the channels 146 to a desired location, and then re-setting the set screws. With the trigger safety pin 105 thus movably positionable upon the trigger guard base member 126, a trigger pin distance between the trigger guard support 106 and a trigger safety pin 105 can be adjusted to adapt the configuration of the trigger guard support assembly 104 to the trigger guards of a wide variety of firearms.

FIG. 6 also shows the trigger guard support 106 extending forward from the front of the trigger guard base member 126. In a preferred embodiment, the trigger guard support 106 is fixed in position upon the trigger guard base member 126. The trigger guard support 106 is a rigid metal or composite material member, generally immobile with respect to the trigger guard base member 126. The trigger guard support 106 preferably may be a machined aluminum dowel having a cylindrical shape, although it may also define a semi-cylinder or other desired shape (see, e.g., FIGS. 1B and 1C). As mentioned, when the trigger guard support assembly 104 is attached within the housing 101 and a gun 103 is disposed in the apparatus 100, the trigger safety pin 105 serves to abut the inside of the gun's trigger guard or grip when the gun shifts upward within the housing. The position of the trigger safety pin 105 (upon base member 126) in relation to the trigger guard support 106 is selected such that if a gun within the housing 101 shifts upward, the trigger safety pin 105 contacts the rear part of the gun's trigger guard (see FIG. 3) before the trigger guard support 106 contacts the gun's trigger, thereby preventing accidental depression of the gun's trigger by the trigger guard support 106. Thus the trigger pin distance between the trigger guard support 106 and the trigger safety pin 105 is adjustable to permit the trigger guard support assembly 104 to safely store a variety of firearms types.

Because the position of the trigger guard base member 126 also is movably attachable at any of a plurality of positions selectively to adjust the base member separation distance between the trigger guard base member 126 and at least one of the housing walls (123, 124), the secondary adjustability of the trigger safety pin 105 upon the trigger guard base member results in a versatile apparatus 100 that can be adapted to receive and hold firearms having a wide variety of dimensions.

In an alternative embodiment of the trigger guard support assembly 104, the trigger guard support 106 is movable in relation to the trigger guard base member 126, with the trigger safety pin 105 being fixed to the trigger guard base member. A person of ordinary skill in the art notes (with combined reference to FIGS. 1B and 6) that the trigger pin distance can be adjusted by either having a movable trigger safety pin 105, or a movable trigger guard support. However, it is preferred to have the trigger guard support 106 securely fixed to the trigger guard base member 126, as the trigger guard support member bears much more of the weight of the firearm than does the safety pin 105.

Figure 7:
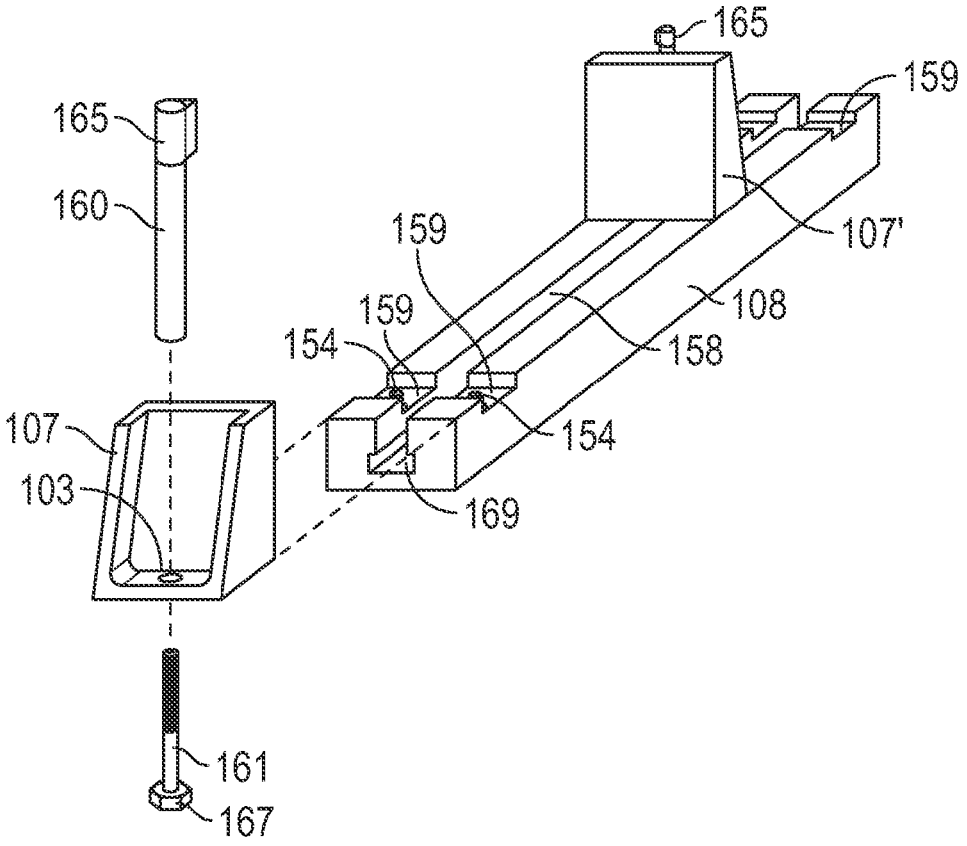
FIG. 7 is a side perspective and partially exploded view of a possible embodiment of the adjustable forward or upper support assembly, viewed in isolation, and including a clamps track, which assembly is adjustably positionable within the housing of the apparatus.

Reference is made to FIG. 7, an enlarged, partially exploded isometric view, in isolation, of a possible version of a forward or upper support assembly, including a clamps track 108 and a pair of side clamp members 107, 107'. It is understood that an apparatus may have a plurality of clamps tracks 108 fastened on the back 122 of the housing (as indicated, e.g., in FIG. 3), in which case a pair of side clamp members 107, 107' can be temporarily and detachably connected to any selected one of the plurality of clamps tracks. Alternatively, a single clamps track 108 can be selectively positionable within the interior of the housing 101.

The forward support assembly of FIG. 7 thus is by way of example, and it is to be understood that alternative configurations of the track 108 and the side members 107, 107' can be devised within the scope of the invention; particularly, alternative means and modes for slidably engaging one or both side members to the track are within the capability of a person of ordinary skill. A preferred embodiment of the security apparatus 100 features a single clamps track assembly that includes a clamps track 108 movably attachable to the housing back 122 at any of a plurality of locations within the housing's interior, and two side clamp members 107, 107' upon the clamps track 108. At least one of the members 107, 107' is movably positionable upon the clamps track 108 to adjust a clamp member separation distance between the two clamp members 107 and 107'. The clamps track 108 is a rigid oblong member preferably fabricated from machined aluminum or other lightweight metal alloy or the like. The side clamps members 107, 107' also may be composed of machined metal, or alternatively from some other suitable rigid material.

As best seen in FIG. 7, a T-channel 158 is centrally defined in the front of, and running the length (or a substantial portion of the length) of, the clamps track 108. The T-channel 158 serves to receive components of the side clamps 107 to permit a sliding controlled engagement of at least one clamp member 107 with the track 108. The T-channel 158 defines a broader lateral dimension at its bottom, and a narrower lateral dimension defining the mouth of the channel along the front (top, as seen in the figure) of the clamps track 108. The broader dimension of the T-channel constitutes a locking socket 169 at the bottom of the channel, and into which the head of a clamp locking bolt is slidably disposed, as described further herein. A plurality of sinks or recesses 159 also are defined in the top of the clamps track 108, in which are provided a plurality of track attachment apertures 154 penetrating through the track 108. Screws may be disposed through the track attachment apertures 154, and screwed into complementary nuts situated in the recesses 159, to releasably attach the clamps track 108 to the back 122 of the main housing 101. As mentioned, a pre-devised array of track mounting holes are defined in the back 122 of the main housing, and accept screws or bolts which extend into the housing interior.

The track mounting holes are deliberately arranged such that track mounting screws (preferably associated pairs of such screws) are manually alignable with corresponding ones (preferably pairs) of track attachment apertures 154. The user selects which ones of the housing's track mounting holes to use, in order to adaptably situate and temporarily secure the track 108 at the optimal location within the interior of the housing 101, so to customize the position of the track 108 to the configuration of the firearm to be stowed.

Once a clamps track is installed in the apparatus housing 101, it can remain in position until a user desires to stow a different gun. Disengagement of the track mounting screws and nuts from the track 108, and relocating them to different selected track mounting holes in the housing back 122, permits the track to be relocated and then re-secured (with the screws and nuts) to customize the apparatus to receive and hold the different gun.

The position of at least one, and preferably the positions of two, of the side clamp members 107, 107' in relation to the clamps track 108 are provided by the clamp member(s) being slidably movable along the track. Movably positionable side clamp members 107, 107' permit a user to adjust the separation distance between and separating the two clamp members. Description herein of one side clamp member 107 and its associated subcomponents preferably serves to describe both clamp members 107, 107'. Still, it is understood that in alternative embodiments of the apparatus and system, only one of the side clamps is movable along the clamps track 108, in which instance an immobile side clamp is rigidly secured on the track at a determined fixed location, and thus lacks subcomponents for allowing its adjustable mobility along the track. Having only one movable side clamp member movably positionable upon the clamps track 108 nevertheless permits a user to adjust a clamp member separation distance between two clamp members 107, 107'.

Both the clamp members 107, 107' preferably are detachable from the clamp track 108 and slidable thereon. Referring especially still to FIG. 7, a clamp member 107 may include a clamp adjustment pin 160 threadably engagable with a locking bolt 161. The adjustment pin 160 has an axial threaded bore into which the locking bolt can be screwed. The locking bolt 161 can be passed through a locking hole 103 in the bottom of the clamp member 107. Locking bolt 161 has a head 167 whose lateral dimension exceeds the width of the mouth of the T-channel 158 in the track 108, but is less than the width of the locking socket 169 portion of the T-channel. A knob 165 permits the screwed connection between the clamp adjustment pin 160 and the locking bolt 161 to be adjusted manually. The adjustable engagement between the clamp member 107 and the track 108 is provided by slidably situating the locking bolt head 167 into the locking socket 169, inserting the locking bolt 161 through the locking hole 103 in the floor of the clamp member 107, resting the clamp member upon the front of the track 108, and then screwing the adjustment pin 160 over the locking bolt 161. Turning the adjustment pin 160 (e.g., by means of the knob 165) clockwise draws the bolt 161 into the pin, thus controllably tightening the pin against the floor of the clamp member 107 (as the bolt head 167 is held within the locking socket 169), thereby pressing the clamp member 107 firmly against the tip of the track 108. A screwed tightening of the adjustment pin 160 securely yet releasably locks the clamp member 107 in the selected position axially along the track 108. The location of the clamp member 107 upon the track 108 can be changed by loosening the rotating the pin 160. The clamp adjustment pin 160 is rotated clockwise to unscrew partially its engagement with the locking bolt 161, to release the clamping action of the pin 160 and bolt 161 which presses the clamp member 107 against the track 108. With the bottom of the clamp member released from tight contact with the track, the bolt head 167 is free to move along and within the T-channel locking socket 169, and the clamp member 107 can slide along the front (upper surface in FIG. 7) of the track. The user may simply then slide the clamp member 107 to a desired new position along the track 108 (e.g., in gentle contact with a firearm). The adjustment pin 160 is again tightened (by screwing down around the locking bolt 161) to pull the bolt head 167 upward and pushing the clamp member 107 downward to once again temporarily clamp the side member 107 into a secure position on the track 108. The position of either or both the side clamp members 107, 107' thereby can be repeatedly selectively changed and re-secured to adjust the separation distance between the clamp members to adapt the security apparatus 100 to a particular firearm.

Continued reference is made to FIG. 7. One or both side clamp members 107, 107' preferably are rotatable about an axis perpendicular to the clamps track 108, allowing the clamp member(s) 107 and/or 107' to pivot in position relative to the gun 103 (e.g., the forestock 133), to better adapt the orientation of the clamp member(s) to the gun's profile. Once pivoted to a desired orientation, the angular position of the clamp members relative to the track 108 (and to the gun) can be temporarily fixed. A clamp member's axis of rotation in this regard is defined generally by the coaxes of the adjustment pin 160 and locking bolt 161. The screwed engagement of the pin 160 with the bolt 161 may be temporarily loosened, releasing the clamping pressure of the member 107 against the track 108, thereby allowing the member 107 to rotate about the axis defined by the pin and bolt, and relative to the track 108. This allows the side clamp member 107 to pivot in position relative to a portion of the forearm in the apparatus 100, so that the orientation of the clamp member is optimized for contact with the firearm. When the selected orientation of the clamp member 107 has been obtained by its rotation relative to the track 108, its angular orientation in relation to the gun can be releasably secured by simply re-tightening the screed engagement of the pin 106 with the bolt 161. FIG. 3 depicts the clamp members 107, 107', by way of example, as both having been pivoted and temporarily secured in a position generally parallel to the axis of the forestock 133, and aligned with the clamps track 108. It is to be understood that the angular position of either clamp member, relative to the longitudinal axis of the track 108, can be adjusted as needed to best present the respective faces of the clamp members 107, 107' to the corresponding opposite sides of the firearm.

Embodiments of the present invention have been described. The embodiments have provided for a mechanical housing 101 of such construction and materials to securely hold a variety of rifle or shotgun makes and models, and allow timely and discrete access to a weapon 103 secured therein.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. For example, modification of the door to open in other directions or attach by means of differing hardware other than hinge may be applied since the purpose for the removable door or cover is to allow access and closure of same. Further, adding variations of materials and configurations in combination or alone which increase the ability of the aforementioned invention to accept variations in rifle or shotgun model configuration securely should be considered without limitation.

What is claimed is:

1. A firearm securing apparatus comprising:
- a housing having an interior and comprising:
  - a back;
  - a first wall and a second wall, the first and second walls extending from the back;
- a door assembly pivotally connected to one of the walls and pivotal between an open position and a closed position;
- means for releasably locking the door assembly in the closed position;
- a first access inhibitor comprising an elastically bendable material extending a first length from the first wall toward the second wall; and
- a second access inhibitor associated with the first access inhibitor and comprising an elastically bendable material and extending a second length from the second wall toward the first wall, the first and second access inhibitors defining a first gap between them;
- wherein the first length or the second length is changeable by bending the first or the second access inhibitor to adjust a dimension of the first gap.

2. The apparatus according to claim 1, wherein the first and second access inhibitors are disposed at a top of the housing.

3. The apparatus according to claim 1, wherein the first length and the second length are changeable by cutting the first and second access inhibitors.

4. The apparatus according to claim 1 further comprising:
- a third access inhibitor extending a third length from the first wall toward the second wall; and
- a fourth access inhibitor associated with the third access inhibitor and extending a fourth length from the second wall toward the first wall, the third and fourth access inhibitors defining a second gap between them;
- wherein at least the third length is changeable to adjust a dimension of the second gap.

5. The apparatus according to claim 4, wherein the third and fourth access inhibitors are disposed at a bottom of the housing.

6. The apparatus according to claim 4 further comprising a pair of door flaps attached on the door assembly, wherein when the door assembly is in the closed position the door flaps overlap the access inhibitors.

7. The apparatus according to claim 4, wherein the fourth length is changeable to adjust a dimension of the second gap.

8. The apparatus according to claim 7, wherein the third length and the fourth length are changeable by cutting the third and fourth access inhibitors.

9. The apparatus according to claim 7, wherein the third and fourth access inhibitors comprise an elastically bendable material, and the third length and the fourth length are changeable by bending the third and fourth access inhibitors.

10. The apparatus according to claim 1 further comprising:
- a trigger guard base member movably attachable to the back at any of a plurality of positions within the interior; and
- a trigger guard support extending away from the trigger guard base member.

11. The apparatus according to claim 10, wherein the trigger guard base member is movably attachable to the back at any of a plurality of positions selectively to adjust a base member separation distance between the trigger guard base member and at least one of the housing walls.

12. The apparatus according to claim 10 further comprising a trigger safety pin movably positionable upon the trigger guard base member to adjust a trigger pin distance between the trigger guard support and the trigger safety pin.

13. An apparatus according to claim 1 further comprising:
- a support assembly track movably attachable to the back at any of a plurality of positions within the interior;
- a trigger guard base member selectively slidably movable along the support assembly track; and
- a trigger guard support extending away from the trigger guard base member.

14. The apparatus according to claim 13 further comprising a trigger safety pin movably positionable upon the trigger guard base member to adjust a trigger pin distance between the trigger guard support and the trigger safety pin.

15. A firearm securing apparatus comprising:
- a housing having an interior and comprising:
  - a back;
  - a first wall and a second wall, the first and second walls extending from the back;
- a door assembly pivotally connected to one of the walls and pivotal between an open position and a closed position;
- means for releasably locking the door assembly in the closed position;
- a first access inhibitor extending a first length from the first wall toward the second wall;
- a second access inhibitor associated with the first access inhibitor and extending a second length from the second wall toward the first wall, the first and second access inhibitors defining a first gap between them;

a clamps track movably attachable to the back at at least one location within the interior; and two clamp members upon the clamps track, at least one of the clamp members movably positionable upon the clamps track to adjust a clamp member separation distance between the clamp members;

wherein at least the first length is changeable to adjust a dimension of the first gap.

16. The apparatus according to claim 15 wherein the clamps track is movably attachable at any of a plurality of positions selectively to adjust a clamps track assembly separation distance between the clamps track and at least one of the access inhibitors.

17. The apparatus according to claim 15 wherein at least one of the clamp members is rotatable about an axis perpendicular to the clamps track.

18. A firearm securing apparatus comprising:

a housing having an interior and comprising:

a back;

a first wall and a second wall, the first and second walls extending from the back;

a door assembly pivotally connected to one of the walls and pivotal between an open position and a closed position;

means for releasably locking the door assembly in the closed position;

a first access inhibitor extending a first length from the first wall toward the second wall;

a second access inhibitor extending a second length from the second wall toward the first wall, the first and second access inhibitors defining a first gap between them;

a third access inhibitor extending a third length from the first wall toward the second wall;

a fourth access inhibitor extending a fourth length from the second wall toward the first wall, the third and fourth access inhibitors defining a second gap between them;

a support assembly track movably attachable to the back;

a trigger guard base member selectively slidably movable along the support assembly track; and a trigger guard support extending away from the trigger guard base member;

wherein at least the first length is changeable to adjust a dimension of the first gap, and wherein at least the third length is changeable to adjust a dimension of the second gap.

* * * * *